US005347817A

United States Patent [19]

Kim

[11] Patent Number: 5,347,817

[45] Date of Patent: Sep. 20, 1994

[54] ACCUMULATOR CONSTRUCTION OF COOLING HEATING DUAL-PURPOSE AIR CONDITIONER

[75] Inventor: Jong-Youb Kim, Suwon City, Rep. of Korea

[73] Assignee: Samsung Electronics Co., Ltd., Suwon City, Rep. of Korea

[21] Appl. No.: 93,719

[22] Filed: Jul. 20, 1993

[30] Foreign Application Priority Data

Jul. 22, 1992 [KR] Rep. of Korea ..... 92-13527

[51] Int. Cl.[5] ..... F25B 43/00

[52] U.S. Cl. ..... 62/471; 62/503

[58] Field of Search ..... 62/503, 471

[56] References Cited

U.S. PATENT DOCUMENTS

| | | | |
|---|---|---|---|
| 2,570,962 | 10/1951 | McBroom | 62/503 |
| 3,060,704 | 10/1962 | Miller | 62/503 |
| 3,765,192 | 10/1973 | Root | 62/503 X |
| 3,796,064 | 3/1974 | Ladusaw | 62/503 |
| 3,938,353 | 2/1976 | Wrenn, Jr. et al. | 62/503 |
| 4,757,696 | 7/1988 | Gannaway | 62/503 |
| 5,247,813 | 9/1993 | Bottum | 62/503 |

*Primary Examiner*—William E. Tapolcai

*Attorney, Agent, or Firm*—Burns, Doane, Swecker & Mathis

[57] ABSTRACT

An air conditioning system circulates a mixture of refrigerant fluid and lubricating oil. An accumulator is disposed upstream of a compressor to separate gaseous refrigerant from liquid refrigerant and oil. The accumulator includes an outer case, an inner case, an upstanding pipe, and a baffle plate disposed in the outer case and above the inner case. Gaseous refrigerant exits the accumulator through the pipe. Oil and possibly liquid refrigerant collect in the inner case around the pipe. Liquid refrigerant and possibly oil collect outside of the inner case. Each of the pipe and inner case include vertically spaced oil-return holes.

8 Claims, 5 Drawing Sheets

ACCUMULATOR CONSTRUCTION OF COOLING HEATING DUAL-PURPOSE AIR CONDITIONER

BACKGROUND OF THE INVENTION

1. Field of the Invention

The present invention relates to a cooling/heating dual-purpose air conditioner, and more particularly to an accumulator construcation of a cooling/heating dual-purpose air conditioner for preventing a liquid refrigerant from flowing into a compressor resulting from a lack of heat source in accordance with a decrease of outside temperature during a heating, and at the same time for achieving a smooth retrieval of oil.

2. Description of the Prior Art

Generally, a cooling/heating dual-purpose air conditioner performs a continuous process of compression, condensation, expansion and evaporation to thereby achieve a heating or performs the above process reversely to thereby achieve a cooling or defrosting.

FIG. 5 depicts a refrigerant cycle in a conventional air conditioner.

In FIG. 5, a high-temperature and high-pressure refrigerant compressed at a compressor 1 is inflowed into an indoor heat exchange 4 through a four-way valve 2 during the heating.

A condensation reaction is realized in the high-temperature, high-pressure refrigerant inflowed into the indoor heat exchange 4 by a static pressure transfer.

The refrigerant condensed at the indoor heat exchange 4 passes sequentially through pressure reducers 6 and 8 to thereby be adiabatically expanded.

The refrigerant adiabatically expanded at the pressure reducers 6 and 8 is induced into an outdoor heat exchanger 3 to thereby be evaporated by a static pressure heat transfer.

The refrigerant drained from the outdoor heat exchanger 3 passes sequentialy through accumulators 12 and 13 via the four-way valve 2 and only the evaporated refrigerant is re-induced into the compressor 1.

Meanwhile, a refrigerant cycle reversed from the above cycle is performed during the cooling and defrosting.

The four-way valve 2 sends the refrigerant from the compressor 1 to the indoor heat exchanger 4 during the heating, and during the cooling and defrosting, the refrigerant from the compressor 1 is sent to the outdoor heat exchanger 3.

Meanwhile, a reference numeral 7 is a nonreturn valve which passes the refrigerant during the cooling and checks the refrigerant during the heating.

In the refrigerant cycle thus constructed, the refrigerant gas is supposed to be inflowed into the compressor 1 as a perfect gaseous refrigerant after the refrigerant gas is heat-exchanged at the outdoor heat exchanger 3, however because a perfect heat exchange can not be realized when the outdoor temperature is very low (generally below 3 degrees Celsius) due to the lack of heat source, some portions of the liquefied refrigerant gas which has yet to be heat-exchanged are induced into the compressor 1 along with the gaseous refrigerant to thereby downgrade an efficiency of the compressor.

In the words, when the liquefied refrigerant is introduced into the compressor 1, there occurs a hydraulic compression phenomenon wherein non-compressive liquid changes instantly to gaseous material to thereby increase a cubic volume of refrigerant, so that damage to the compressor and a diminishing of its efficiency may result.

Accordingly, accumulators 12 and 13 are used in series on a refrigerant pipe interconnecting the outdoor heat exchanger 3 and the compressor 1 in order to completely separate the liquified refrigerant contained in the gaseous refrigerent.

FIG. 6 is a constitutional diagram of accumulator installations 12 and 13 in the conventional cooling/heating dual-purpose air conditioner as illustrated in FIG. 5.

In FIG. 6, the refrigerent inflowed into the first accumulator 12 passes through a hole 18*a* formed on a baffle plate 18 and the gaseous refrigerant is inflowed into the second accumulator 13 through a stand pipe 20.

Meanwhile, oil is injected into the compressor in order to smooth off the operation of the compressor 1 and at this moment, the oil is mixed with the refrigerant in the compressor 1 to thereby be discharged.

The oil flows to the bottom of the first accumulator 12 through the hole 18*a* formed on the baffle plate 18 to thereby flow into the stand pipe 20 through an oil return hole 20*a*.

The refrigerant mixed with the compressor oil thus explained is flowed into the second accumulator 13 to thereby be filtered at a filtering mesh 22.

The refrigerant whose impurities have been filtered off at the filtering mesh 22 passes through a hole 24*a* of the baffle plate 24 and gaseous refrigerant is flowed into the compressor 1 through a stand pipe 26.

The compressor oil that has passed the hole 24*a* of the buffle plate 24 flows to the bottom of the second accumulator 13 to thereby be retrieved by the compressor 1 through the oil return hole 26*a*.

Here, the buffle plates 18 or 24 are formed with a plurality of holes a,b,c and d as illustrated in FIG. 7, and the center of the baffle plate 18 or 24 where the stand pipe 20 or 26 is disposed protrudes upwardly and the holes a,b,c and d are formed around a periphery of the respective protrusions.

Accordingly, the gaseous refrigerant that has passed through a plurality of holes formed on the baffle plate 18 or 24 is flowed into the stand pipe 20 or 26, and the liquid refrigerant flows toward the bottoms of the first and second accumulators 12 and 13 to thereby be accumulated, so that only the gaseous refrigerant can be flowed into the compressor 1.

When the liquefied refrigerant which has not evaporated the outdoor heat exchanger 3 due to low outdoor temperature is accumulated at the bottom of the first accumulator 12 or second accumulator 13, the above-mentioned lubricating oil is separated to thereby float on a surface of the liquified refrigerant.

Therefore, the oil might not be retrieved through the oil return holes 20*a* or 26*a*, so that the compressor 1 cannot smoothly be operated.

Furthermore, because a plurality of accumulators are connected in series to prevent the liquefied refrigerant from flowing into the compressor, a problem arises in that an installation calls for a large space, so that construction gets complicated and an efficiency decreases due to a pressure drop resulting from a dual expansion.

SUMMARY OF THE INVENTION

Accordingly, the present invention is presented to solve the aforementioned problems and it is therefore an object of the present invention to provide an accumulator construction of a cooling/heating dual-purpose air conditioner for retrieving oil smoothly, even though liquefied refrigerant is accumulated in the accumulator by forming a plurality of oil return holes at a predetermined interval.

It is another object of the present invention to provide an accumulator construction of a cooling/heating dual-purpose air conditioner for preventing the liquefied refrigerant from flowing into the compressor and at the same time, for simplifying the construction.

In accordance with one object of the present invention, there is provided an accumulator construction of a cooling/heating dual-purpose air conditioner characterized by a plurality of oil return holes formed on a stand pipe which conducts gaseous refrigerant to the outside, the pipe being disposed vertically on an inner center of an outer case.

In accordance with another object of the present invention, there is provided an accumulator construction of a cooling/heating dual-purpose air conditioner characterized by an inner case formed with oil return holes disposed between an outer case and a stand pipe.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Hereinafter, an accumulator construction of a cooling/heating dual-purpose air conditioner will be described in detail with reference to the accompanying drawings.

Figure 1:
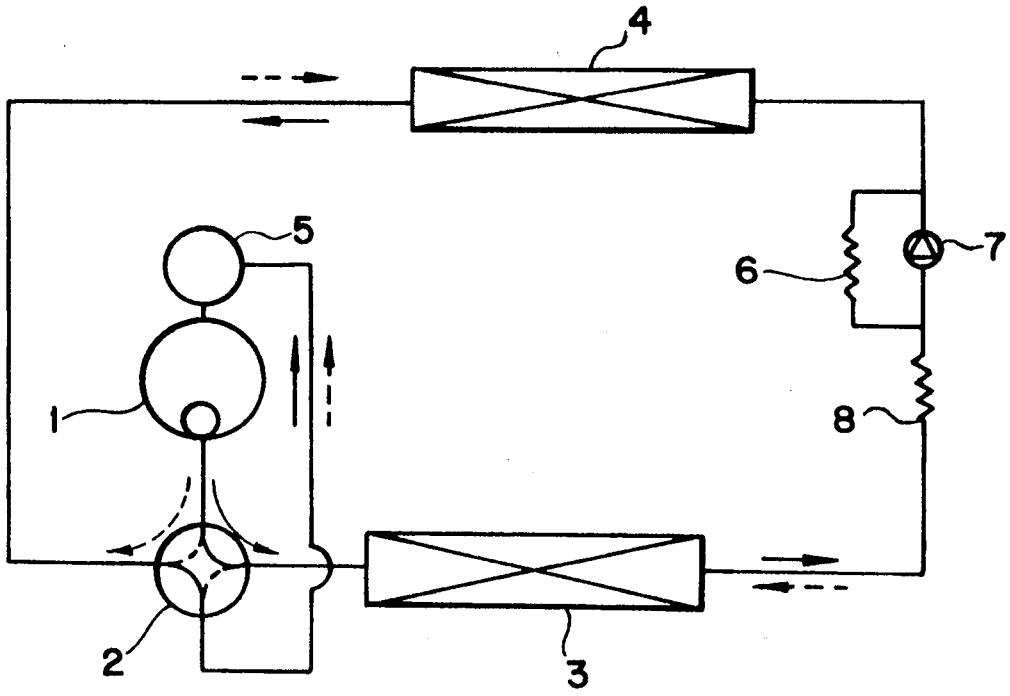
FIG. 1 is a schematic representation of a refrigerant cycle of a cooling/heating dual-purpose air conditioner in accordance with the present invention.
Figure 5:
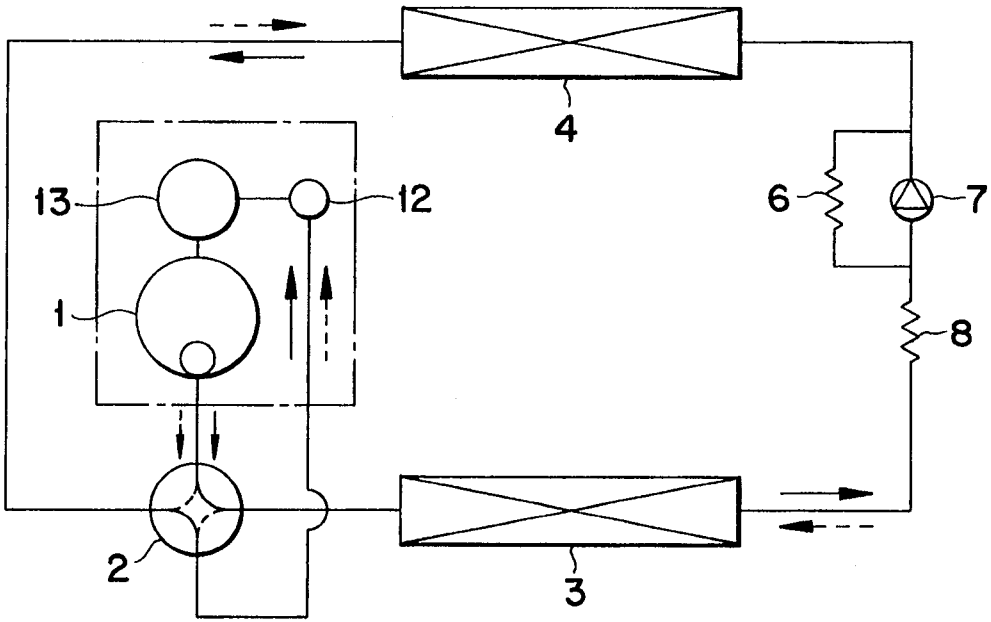
FIG. 5 (PRIOR ART)
FIG. 5 is a schematic representation of a refrigerant cycle in a conventional cooling/heating dual-purpose air conditioner.
Figure 6:
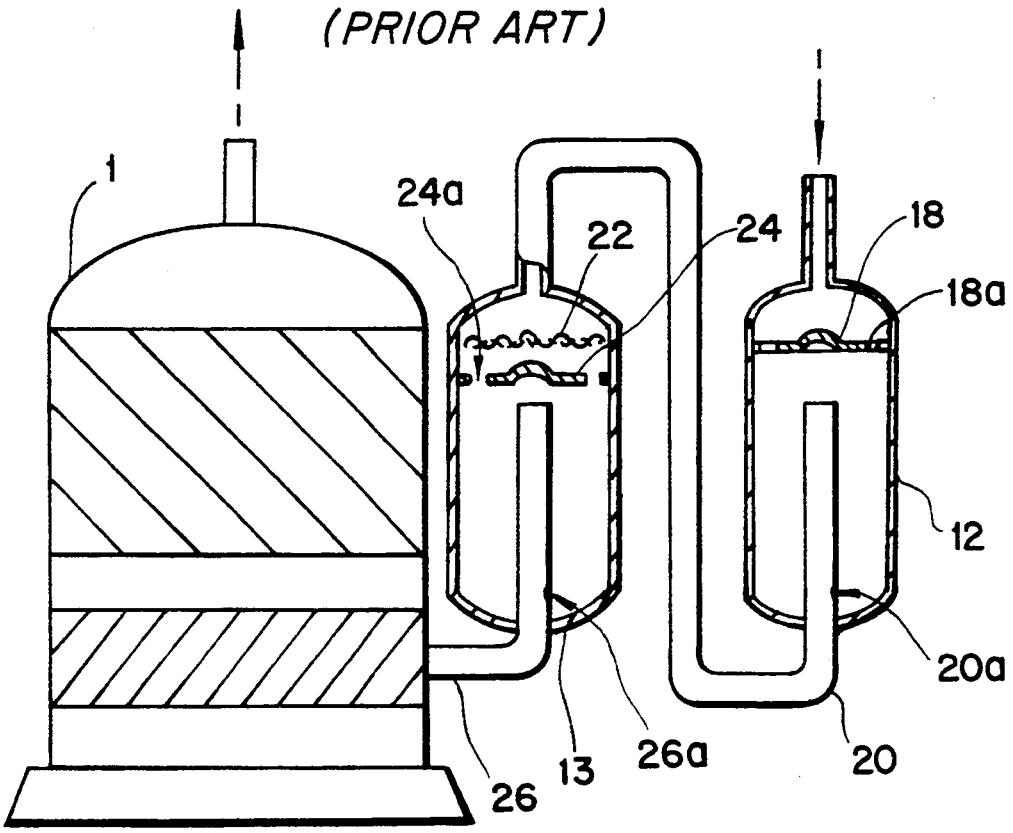
FIG. 6 (PRIOR ART)
FIG. 6 is a vertical sectional view of a compressor and an accumulator installation in the conventional cooling/heating dual-purpose air conditioner depicted in FIG. 5.
Figure 7:
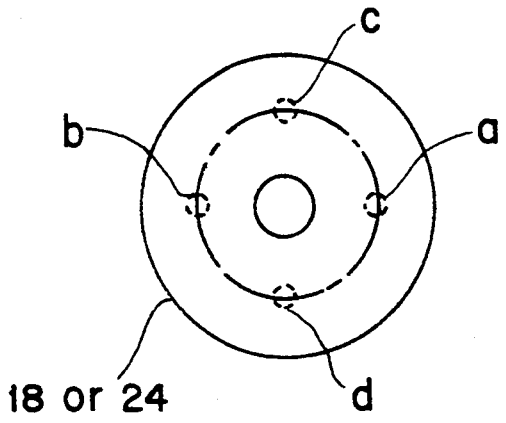
FIG. 7 (PRIOR ART)
FIG. 7 is a plan view of a babble plate construction depicted in FIG. 6.

FIG. 1 depicts a refrigerant cycle of a cooling/heating dual-purpose air conditioner in accordance with the present invention, which is operated in the same manner as the refrigerant cycle of a conventional air conditioner as illustrated in FIG. 5.

Figure 2:
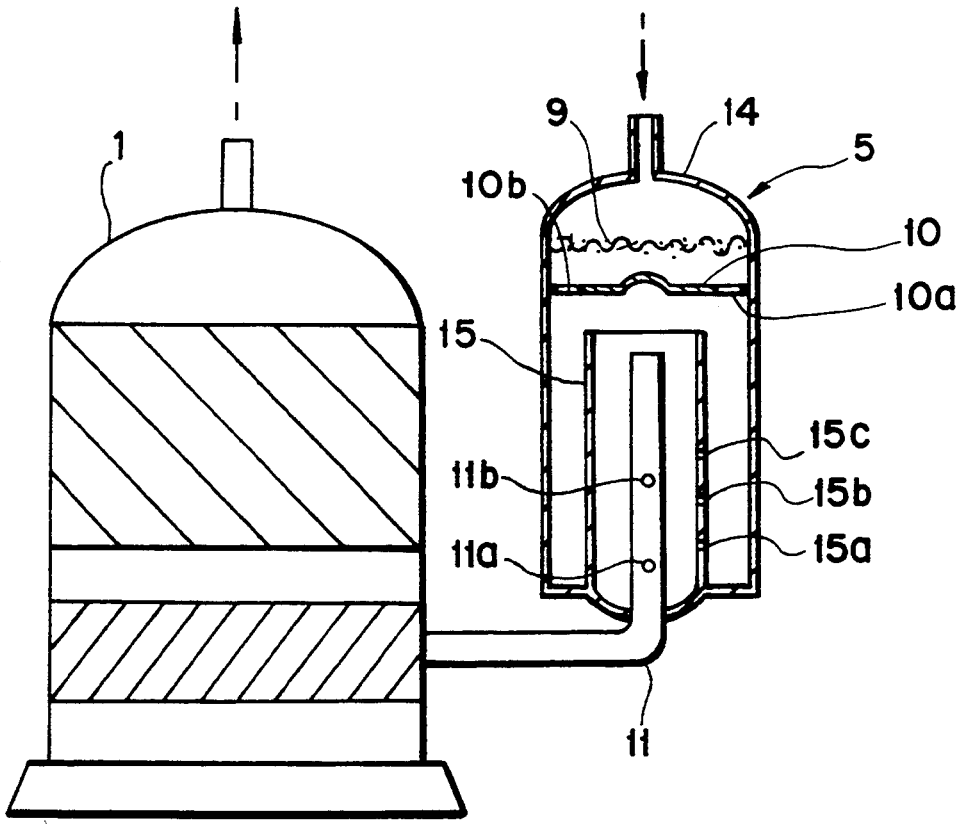
FIG. 2 is a vertical sectional view of a compressor and an accumulator installation in accordance with the present invention.

In FIG. 2, the accumulator 5 is designed to supply to the compressor 1 the oil and gaseous refrigerant out of refrigerants received from the outdoor heat exchanger 3.

Figure 3:
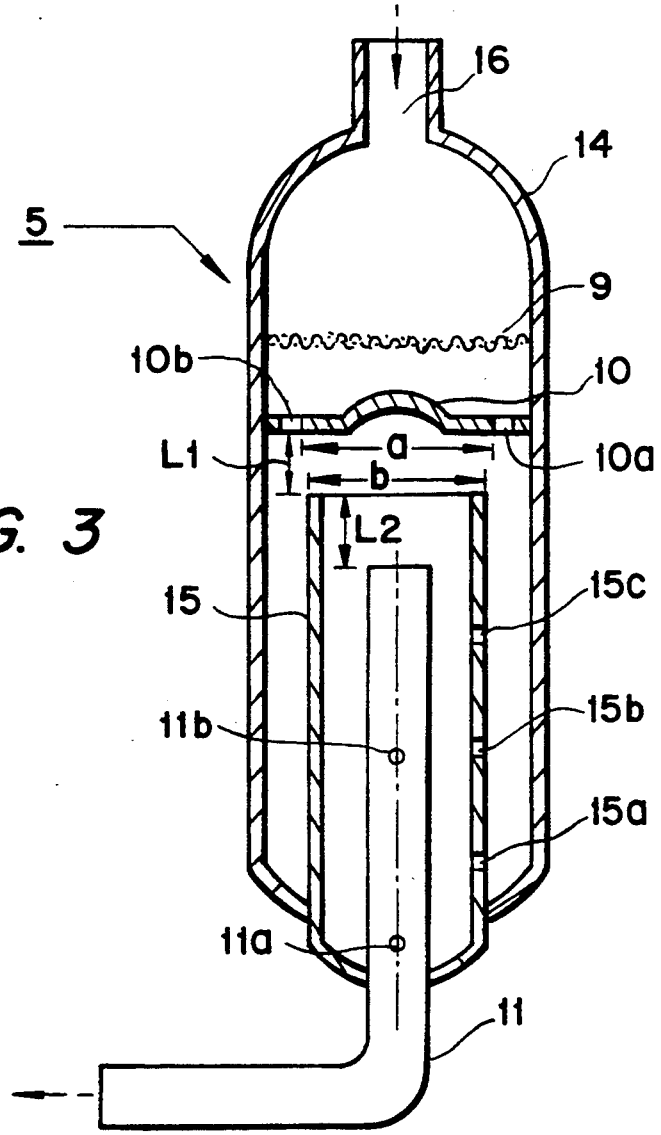
FIG. 3 is an enlarged vertical sectional view of the accumulator depicted in FIG. 2.

In FIG. 3, the accumulator 5 consists of a dual construction having an outer case 14 and an inner case 15 and a stand pipe 11 disposed within the inner case 15.

A filtering mesh 9 and a baffle plate 10 are disposed above the upper side of the inner case 15.

Meanwhile, the stand pipe 11 which conducts the gaseous refrigerant by being disposed vertically in the center of the inner case 15 is formed with a plurality of oil return holes 11*a* and 11*b* from a lower side to the upper side at predetermined intervals.

Furthermore, the inner case 15 is also formed with a plurality of oil return holes 15*a*, 15*b* and 15*c* from the lower side to the upper side at predetermined intervals.

It is advisable to provide a vertical space L1 of approximately 10–20 mm between the baffle plate 10 and the inner case 15, and it is also advisable to provide a vertical space L2 from the upper side of the inner case 15 to the stand pipe 11 wherein the length of L1 is between one-third and one-half of the length of L2.

When the refrigerant is flowed into the upper side of the outer case 14 of the accumulator 5 thus constructed, impurities are removed by the filtering mesh 9 and the refrigerant passes through a plurality of holes 10*a* and 10*b* formed on the baffle plate 10 to thereby be diffused.

The gaseous refrigerant after passing the holes 10*a* and 10*b* of the baffle plate 10 flows along with some of the oil into the compressor 1 through the stand pipe 11.

However, during a state lacking for a heat source due to the low outdoor temperature, the refrigerant can not be evaporated completely, so that liquid refrigerant and the oil pass the holes 10*a* and 10*b* of the baffle plate 10 to thereby be flowed to the bottom of the outer case 14.

In other words, pressure in the stand pipe 11 is lowered due to a gas flow and the gaseous refrigerant having a lower density is sucked into the stand pipe 11 to thereby be flowed out.

Likewise, the oil having a higher density than the gaseous refrigerant, travels partway from the holes 10*a*, 10*b* but drops between the inner case 15 and the stand pipe 11, and the liquefied refrigerant having a higher density than the oil drops between the outer case 14 and the inner case 15.

Figure 4:
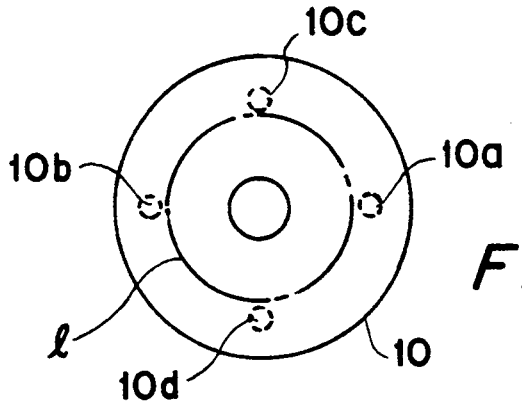
FIG. 4 is a plan view of a baffle plate construction depicted in FIG. 3.

Here, it is advisable to make an outer diameter b of the inner case 15 to be smaller than or equal to a diameter a of a smallest circle 1 made by the holes 10*a*, 10*b*, 10*c* and 10*d* formed on the baffle plate as illustrated in FIGS. 3 and 4.

Though it is advisable that the liquified refrigerant be dropped between the outer case 14 and the inner case 15 as explained in the foregoing, and the oil be dropped between the inner case 15 and the stand pipe 11, part of liquified refrigerant is dropped between the inner case 15 and the stand pipe 11 and part of the oil is dropped between the outer case 14 and inner case 15.

At this point, the oil floats on the liquefied refrigerant collected in the space formed between the outer case 14 and the inner case 15, and the oil flows into the inner case 15 through the oil return hole 15*a*.

Furthermore, the oil floats on the liquefied refrigerant gas collected in the space formed between the stand pipe 11 and inner case 15, and when the liquefied refrigerant is collected up to a position of an oil return hole 11*a*, the oil flows into the stand pipe 11 through the oil return hole 11*a*.

If the liquified refrigerant between the stand pipe 11 and inner case 15 is collected up to a position of the oil return hole 15*a*, the oil flows into the inner case 15 through an oil return hole 15*b*.

When the liquified refrigerant is collected up to a position of an oil return hole 15*c*, the oil floating on the liquefied refrigerant flows into the inner case through the oil return hole 15*c*.

As seen from the foregoing, all the oil flows into the inner case 15 and the flowed-in oil flows into the compressor 1 through the oil return hole 11*a* formed on the stand pipe 11.

If the oil in the inner case 15 is collected up to a position of an oil return hole, or if the oil reaches a position of an oil return hole due to a flow-in of the liquefied refrigerant, the oil is flowed into the compressor 1 through the oil return hole.

As mentioned in the above, the accumulator construction of a cooling/heating dual-purpose air conditioner in accordance with the present invention can achieve an effect of smoothing an operation of the compressor because the liquefied refrigerant can be retrieved into the compressor through a plurality of oil return holes formed from the lower areas of the inner case 15 and the stand pipe 11 to the top areas at predetermined intervals even though the liquefied refrigerant is inflowed in.

Furthermore, doubly-formed accumulator interdicts an inflow of the liquefied refrigerant into the compressor to thereby increase an efficiency of the compressor, achieve an effect of a small installation space and simplify the construction as well.

The foregoing description and drawings are illustrative and are not to be taken as limiting. In practice, many variations are possible to those skilled in the art without departing from the scope of the invention.

Specifically, the above description has specified the oil return holes in detail but they can be increased and decreased according to the situation.

Furthermore, in the aforesaid description, though the accumulator is formed in a double structure, it should be apparent that inner cases can be added in addition to the inner case and the outer case for achievement of the objects described in the present invention.

What is claimed is:

1. An accumulator for use in an air conditioning system which circulates a mixture of refrigerant fluid and lubricating oil, comprising an outer case having inlet means for receiving said mixture, an inner case disposed within said outer case, and outlet means including an upstanding pipe disposed within said inner case for discharging a gaseous component of said refrigerant fluid while oil and a liquid component of said refrigerant fluid collect outside of said pipe, an inner space being defined between said pipe and said inner case, and an outer space being defined between said inner and outer cases, at least said oil collecting in said inner space, and at least said liquid refrigerant collecting in said outer space, said inner case including at least one oil-return hole, and said pipe including at least one oil-return hole.

2. An accumulator according to claim 1 wherein said inner case includes an open upper end situated below an upper end of said outer case.

3. An accumulator according to claim 2 wherein said pipe and inner case are arranged coaxially relative to said outer case.

4. An accumulator according to claim 1 wherein each of said pipe inner case includes vertically spaced oil-return holes.

5. An accumulator according to claim 1 including separating means in said case for separating said gaseous refrigerant from said oil and liquid refrigerant, said separating means comprising an apertured baffle plate over lying an upper entrance end of said pipe.

6. An accumulator according to claim 5 wherein said baffle plate has a plurality of apertures, none of which overlie an upper open end of said inner case.

7. An accumulator according to claim 5 wherein said baffle plate has a plurality of apertures arranged in an annular pattern, an outer diameter of an upper open end of said inner case being no greater than a diameter of a smallest circle on which said apertures lie.

8. An accumulator according to claim 1, including means for conducting said mixture from said inlet means to a location overlying said outer space.

* * * * *